US009495858B2

(12) United States Patent
Kurtovic

(10) Patent No.: US 9,495,858 B2
(45) Date of Patent: Nov. 15, 2016

(54) SMART KEY REMINDER SYSTEM FOR A VEHICLE

(71) Applicant: Toyota Motor Engineering & Manufacturing North America, Inc., Erlanger, KY (US)

(72) Inventor: Kenan Kurtovic, Ferndale, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 14/604,724

(22) Filed: Jan. 25, 2015

(65) Prior Publication Data

US 2016/0217676 A1 Jul. 28, 2016

(51) Int. Cl.
*G08B 21/24* (2006.01)

(52) U.S. Cl.
CPC ..... *G08B 21/24* (2013.01)

(58) Field of Classification Search
CPC ..... G08B 21/24
USPC ..... 340/539.32, 10.1–10.6, 572.1–572.9
See application file for complete search history.

(56) References Cited

U.S. PATENT DOCUMENTS 8,035,503 B2 10/2011 Partin et al.
2005/0099275 A1 5/2005 Kamdar et al.
2007/0216517 A1 9/2007 Kurpinski et al.
2009/0160639 A1* 6/2009 Chu ..... B60R 25/24 340/539.11
2010/0171642 A1* 7/2010 Hassan ..... G01C 17/38 340/992
2012/0050021 A1* 3/2012 Rao ..... B60N 2/002 340/425.5
2012/0322380 A1 12/2012 Nannarone et al.
2014/0091906 A1* 4/2014 Lee ..... G05B 1/01 340/5.61
2014/0277935 A1* 9/2014 Daman ..... G08G 1/127 701/36

* cited by examiner

*Primary Examiner* — George Bugg
*Assistant Examiner* — Thang Tran
(74) *Attorney, Agent, or Firm* — Christopher G. Darrow; Darrow Mustafa PC

(57) ABSTRACT

Described herein is a smart key reminder system. The smart key reminder system prevents a user from mistakenly leaving a vehicle with a wireless smart key in his possession when the vehicle is running, which would otherwise result in the next driver being without a key and stranded once the vehicle is turned off. When the smart key travels more than a predefined distance from the vehicle when the vehicle is running, the smart key reminder system will give the person in possession of the smart key and/or vehicle occupants a warning not to leave the next driver without a key. A system for a vehicle can include a wireless smart key operable to receive an alert in response to a location of the wireless smart key with respect to the vehicle if the vehicle is operating.

20 Claims, 3 Drawing Sheets

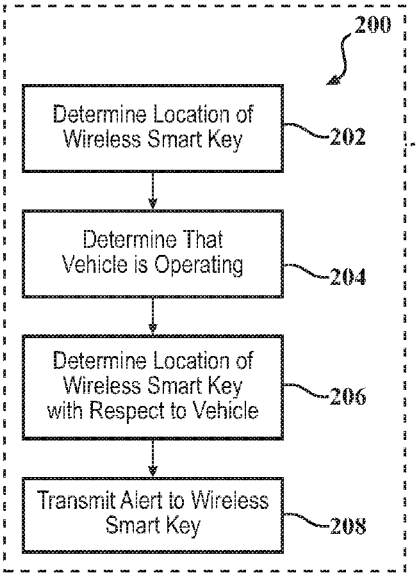
FIG. 3
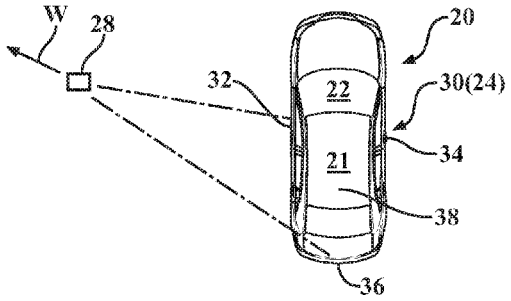
FIG. 5
FIG. 4
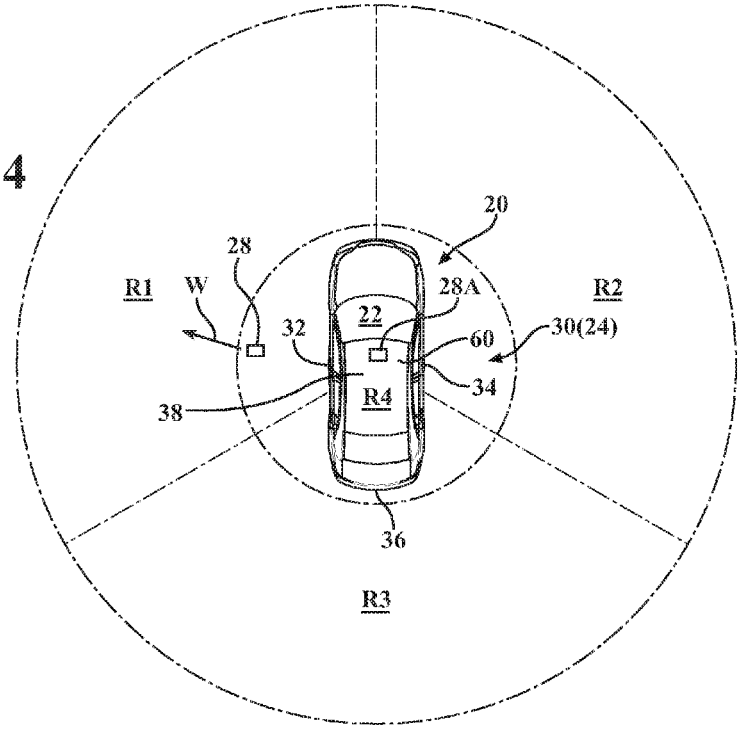

SMART KEY REMINDER SYSTEM FOR A VEHICLE

BACKGROUND

The present disclosure relates to a vehicle and, more particularly, to a smart key reminder system therefor.

Vehicles often include wireless systems to lock and unlock the vehicle. Wireless keys, often referred to as "smart keys," offer a level of convenience for vehicle users to perform various functions from a distance. The smart key operates as a transmitter to send commands to the vehicle to, for example, permit ignition upon pressing a button in the cabin when the key is within a particular range, or unlocking the door when the key is within a particular range and the user grasps the door handle.

SUMMARY

Described herein is a smart key reminder system. The disclosed smart key reminder system prevents a user from mistakenly leaving a vehicle with a wireless smart key in his possession when the vehicle is running, which would otherwise result in the next driver being without a key and stranded once the vehicle is turned off. When the key travels more than a predefined distance from the vehicle when the vehicle is running, the smart key reminder system will send the person in possession of the smart key and/or vehicle occupants a warning not to leave the next driver without a key. A smart key system for a vehicle described herein can include a wireless smart key operable to receive an alert in response to a location of the wireless smart key with respect to the vehicle if the vehicle is operating. The alert thereby provides a reminder to prevent the user from mistakenly leaving the operating vehicle with the wireless smart key in his possession.

A smart key system for a vehicle includes, according to one disclosed non-limiting embodiment, a sensor system operable to detect a wireless smart key; a control system in communication with the sensor system and the wireless smart key, the control system operable to identify a location of a wireless smart key with respect to the vehicle and send an alert to the wireless smart key in response to the location of the wireless smart key with respect to the vehicle and whether the vehicle is operating.

A smart key system includes, according to another disclosed non-limiting embodiment, a wireless smart key operable to receive an alert in response to a location of the wireless smart key with respect to the vehicle and if the vehicle is operating.

A method for alerting a user of a vehicle that remains operating includes, according to another disclosed non-limiting embodiment, identifying a location of a wireless smart key with respect to the vehicle and sending an alert to the wireless smart key.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 3 is a flow chart illustrating operations of the smart key reminder system according to one disclosed non-limiting embodiment;

FIG. 4 is a schematic view of the smart key reminder system operating according to one disclosed non-limiting embodiment; and FIG. 5 is a schematic view of the smart key reminder system operating according to another disclosed non-limiting embodiment.

DETAILED DESCRIPTION

Described herein is a smart key reminder system. The smart key reminder system prevents a user from mistakenly leaving a vehicle with a wireless smart key in his possession when the vehicle is running, which would otherwise result in the next driver being without a key and stranded once the vehicle is turned off. When the key travels more than a predefined distance from the vehicle when the vehicle is running, the smart key reminder system will send the person in possession of the smart key and/or vehicle occupants a warning not to leave the next driver without a key. The smart key reminder system includes a control system in communication with a sensor system and a wireless smart key. The control systems identifies a location of the wireless smart key with respect to the vehicle and sends an alert to the wireless smart key in response to the location of the wireless smart key with respect to the vehicle when the vehicle is operating.

Figure 1:
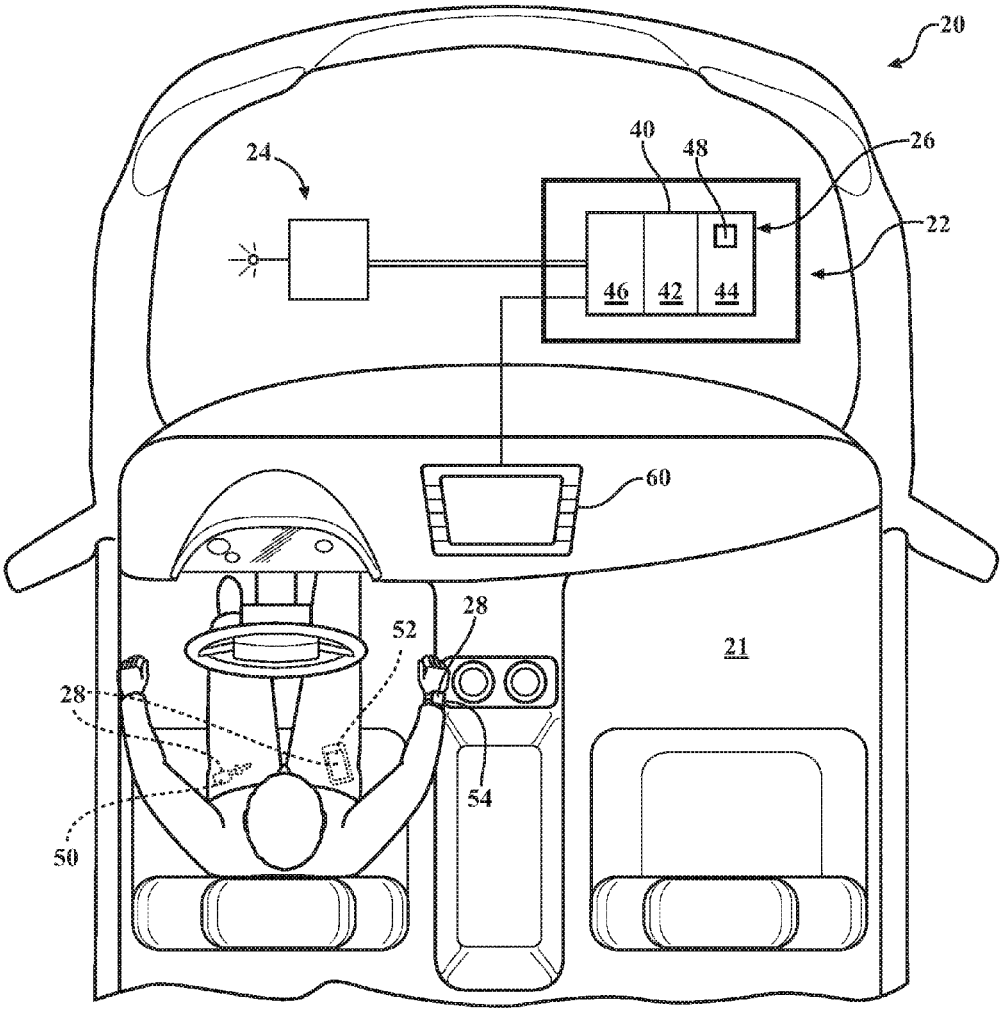
FIG. 1 is a schematic view of an example vehicle for use with a smart key reminder system.

FIG. 1 schematically illustrates a vehicle 20 with a vehicle cabin 21 and a smart key reminder system 22. The smart key reminder system 22 generally includes a sensor system 24, a control system 26, and a wireless smart key 28. It should be appreciated that although particular systems are separately defined, each or any of the systems may be otherwise combined or segregated via hardware and/or software.

Figure 2:
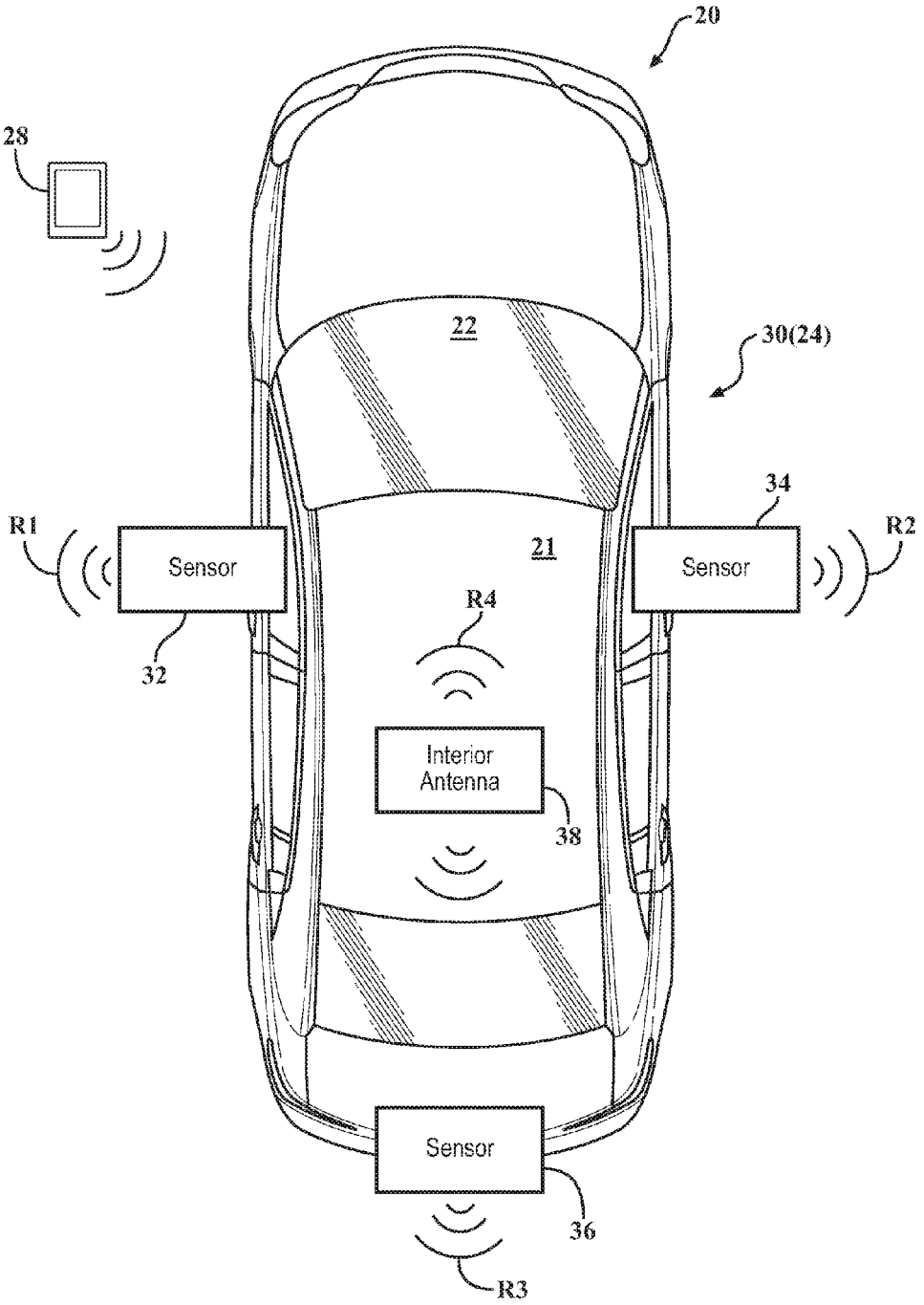
FIG. 2 is a schematic view of an example sensor arrangement for use with the smart key reminder system.

The sensor system 24 may include various sensors operable to identify that the wireless smart key 28 is within a predetermined range. In one disclosed non-limiting embodiment illustrated in FIG. 2, one or more sensors 30 include, for example, a sensor 32 located in a driver's door handle, a sensor 34 located in a passenger door handle, a sensor 36 located in a trunk handle, and a sensor 38 located in the vehicle cabin 21 (FIG. 2). The sensors 32, 34, 36, 38 provide a respective range R1-R4 within which the wireless smart key 28 is identifiable (FIG. 2).

The control system 26 is operable in conjunction with the sensors 32, 34, 36 to identify the wireless smart key 28 to place particular vehicle doors into an unlock standby mode prior to unlocking by a user such as via actuating the door handle. The control system 26 is also operable in conjunction with the sensor 38 to identify that the wireless smart key 28 is within the vehicle cabin 21, i.e., within range R4, to place the vehicle ignition in a standby mode prior to ignition by a user such as by pressing a start button.

The control system 26 generally includes a control module 40 with a processor 42, a memory 44, and an interface 46. The processor 42 may be any type of microprocessor having desired performance characteristics. The control module 40 may be a portion of a central vehicle control, a stand-alone unit, or other system such as a cloud-based system. The memory 44 may include any type of computer readable medium that stores the data and control algorithms 48 described herein. Operational software for the processor 42 and or other systems may also be stored in the memory 44.

The interface 46 facilitates communication with other systems such as the sensor system 24, the wireless smart key 28, and other on board and off board systems. On board systems include, but are not limited to, a vehicle head unit 60 and various sensors such as the sensors 32, 34, 36, 38. Off board vehicle systems include but are not limited to, remote systems such as the wireless smart key 28. The interface 46 may thereby include wired and wireless communication systems such as satellite, cellular, and wireless radios using various types of wireless data communication protocols, e.g., Bluetooth™, ZigBee, ANT™, WiFi, WiMax, and other wireless technology standards to exchange data.

The wireless smart key 28 may include, or be included in via software or electronics, various devices such as, for example, a key fob 50, a personal electronic device 52 (e.g. a tablet, smart phone, or other mobile device), or a wearable device 54 (e.g., a watch, eyeglasses, or other device). That is, the wireless smart key 28 as defined herein includes any device that can be carried or worn by the driver that provides a haptic or other alert capability such as a vibration, light, and/or sound capability. It should be appreciated that each vehicle 20 typically has multiple wireless smart keys 28 associated therewith. Alternatively, or in addition thereto, the alert may include a text message or other such communication should the personal electronic device 52 be operable as the wireless smart key 28.

With reference to FIG. 3, in one disclosed non-limiting embodiment, an algorithm 48 for operation of the smart key reminder system 22 is disclosed in terms of functional block diagrams and it should be appreciated that these functions may be enacted in either dedicated hardware circuitry or programmed software routines capable of execution in a microprocessor based electronics control embodiment. That is, the memory 44 is an example computer storage media having embodied thereon computer-useable instructions such as the algorithm 48 that, when executed, performs a method 200 to track the wireless smart key 28.

Initially, in step 202, the location of the wireless smart key 28 is determined. In one example, the sensors 32, 34, 36 may identify whether the wireless smart key 28 is within one or more of the ranges R1-R3 and/or located within range R4 (i.e., within the vehicle cabin 21) (FIG. 4). Alternatively, or in addition thereto, as shown in FIG. 5, the control system 26 may triangulate upon the location of the wireless smart key 28 and thus determine the velocity and the direction (illustrated schematically by arrow W) of the wireless smart key 28 should a user be carrying the wireless smart key 28.

Next, in step 204 of FIG. 3, it is determined whether the vehicle is operating (i.e., running). The determination may be performed via the vehicle head unit 60, vehicle control unit, engine operation, and/or other vehicle system.

Next, in step 206 of FIG. 3, the location of the wireless smart key 28 is determined. For example, it could be determined that the wireless smart key 28 is within range R1 (i.e., not within the vehicle cabin 21) but that a different wireless smart key 28A is within range R4 (i.e., within the vehicle cabin 21) (FIG. 4). That is, the smart key reminder system 22 determines if any wireless smart key 28, 28A, associated with the vehicle 20 is within range R4 such as if one user with the wireless smart key 28 is leaving the operating vehicle but another user with the different wireless smart key 28A is within the vehicle 20.

Alternatively, or in addition thereto, the control system 26 may utilize triangulation of the wireless smart key 28 to determine that the user is walking away from the vehicle 20 with the wireless smart key 28 (FIG. 5). That is, not only the location of the wireless smart key 28 is determined, but the direction and velocity thereof is determined to predict whether the user is mistakenly leaving the operating vehicle 20 with the wireless smart key 28. Such prediction facilitates generation of an alert at an earlier opportunity than awaiting the user leaving a predetermined range.

Should no proper wireless smart key 28 be within range R4, i.e., within the vehicle cabin 21, or the user is determined to be leaving a predefined area adjacent to the vehicle 20 while the vehicle 20 is operating, the control module 40 sends an alert to the wireless smart key 28 (step 208). The alert may include, for example, a vibration, light, or sound generated by the wireless smart key 28 to gain the attention of the user that indicates the vehicle 20 is still operating. That is, the smart key 28 receives a signal from the control module 40 to trigger the alert. The alert may also be communicated to the vehicle head unit 60 so those in the vehicle are alerted that no proper wireless smart key 28 is present within the vehicle 20.

Alternatively, or in addition thereto, the wireless smart key 28 includes GPS module such that the control module 40 need only communicate with the wireless smart key to request a position thereof. That is, the wireless smart key 28 tracks itself and need only communicate its position to the control module 40 which can then determine a relative position with respect to the control module 40. Location and velocity may be associated with the various ranges as discussed above so that the smart key 28 receives a signal from the control module 40 to trigger the alert.

The use of the terms "a," and "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A smart key reminder system for a vehicle with a vehicle cabin, comprising:

a vehicle-installed control system operable to:

identify whether the vehicle is operating, identify a communicative wireless smart key, a location of the communicative wireless smart key with respect to the vehicle and whether the communicative wireless smart key is within a predefined distance from the vehicle, identify whether another wireless smart key is within the vehicle cabin, and when the vehicle is operating, the communicative wireless smart key is identified as not being within the predefined distance from the vehicle, and another wireless smart key is not identified as being within the vehicle cabin, send an alert to the communicative wireless smart key.

2. The system as recited in claim 1, wherein the predefined distance from the vehicle includes the vehicle cabin.

3. The system as recited in claim 1, wherein identifying the location of the communicative wireless smart key with respect to the vehicle includes identifying whether the communicative wireless smart key is within a predetermined range of the vehicle.

4. The system as recited in claim 1, wherein identifying the location of the communicative wireless smart key with respect to the vehicle includes triangulating the location of the communicative wireless smart key with respect to the vehicle.

5. The system as recited in claim 4, wherein triangulating the location of the communicative wireless smart key with respect to the vehicle includes determining at least one of a speed, a direction and a velocity of the communicative wireless smart key with respect to the vehicle.

6. The system as recited in claim 4, wherein the control system is further operable to:

predict, from the triangulated location of the communicative wireless smart key with respect to the vehicle, whether a user carrying or wearing the communicative wireless smart key is walking away from the vehicle with the communicative wireless smart key in their possession, and when the vehicle is operating, it is predicted that the user carrying or wearing the communicative wireless smart key is walking away from the vehicle with the communicative wireless smart key in their possession, the communicative wireless smart key is identified as not being within the predefined distance from the vehicle, and another wireless smart key is not identified as being within the vehicle cabin, send the alert to the communicative wireless smart key.

7. The system as recited in claim 1, further comprising:

the communicative wireless smart key, the communicative wireless smart key operable to:

receive the alert, and issue a warning to a user carrying or wearing the communicative wireless smart key in response to the alert.

8. The system as recited in claim 7, wherein the warning is for the user not to leave the vehicle while the vehicle is operating and while still in possession of the communicative wireless smart key.

9. The system as recited in claim 7, wherein the warning is for the user not to leave another user without a key to the vehicle while the vehicle is operating.

10. The system as recited in claim 7, wherein the communicative wireless smart key issues the warning at least in part by vibrating.

11. The system as recited in claim 7, wherein the communicative wireless smart key is a key fob.

12. The system as recited in claim 7, wherein:

the communicative wireless smart key is a personal electronic device with GPS capability, and is further operable to communicate its GPS position, and the control system is further operable to receive the GPS position of the communicative wireless smart key, and identify the location of the communicative wireless smart key with respect to the vehicle based on its GPS position.

13. The system as recited in claim 1, further comprising:

a vehicle-installed sensor system in communication with the control system, the sensor system operable to:

determine whether the communicative wireless smart key is within a predetermined range of the vehicle, and communicate corresponding signals to the control system from which the control system is operable to identify whether the communicative wireless smart key is within the predefined distance from the vehicle.

14. The system as recited in claim 1, further comprising:

a vehicle-installed head unit in communication with the control system, wherein the control system is operable to send the alert to the head unit, and the head unit is operable to issue a warning to a user in the vehicle cabin in response to the alert that the user is being left without a key to the vehicle while the vehicle is operating.

15. A method for alerting a user of a vehicle with a vehicle cabin that the vehicle remains operating, comprising:

with a vehicle-installed control system:

identify whether the vehicle is operating, identify a communicative wireless smart key, a location of the communicative wireless smart key with respect to the vehicle and whether the communicative wireless smart key is within a predefined distance from the vehicle, identify whether another wireless smart key is within the vehicle cabin, and when the vehicle is operating, the communicative wireless smart key is identified as not being within the predefined distance from the vehicle, and another wireless smart key is not identified as being within the vehicle cabin, send an alert to the communicative wireless smart key.

16. The method as recited in claim 15, further comprising: with the control system:

triangulating the location of the communicative wireless smart key with respect to the vehicle as part of identifying its location with respect to the vehicle, predict, from the triangulated location of the communicative wireless smart key with respect to the vehicle, whether a user carrying or wearing the communicative wireless smart key is walking away from the vehicle with the communicative wireless smart key in their possession, and when the vehicle is operating, it is predicted that the user carrying or wearing the communicative wireless smart key is walking away from the vehicle with the communicative wireless smart key in their possession, the communicative wireless smart key is identified as not being within the predefined distance from the vehicle, and another wireless smart key is not identified as being within the vehicle cabin, send the alert to the communicative wireless smart key.

17. The method as recited in claim 15, further comprising: with the communicative wireless smart key:

receive the alert, and issue a warning to a user carrying or wearing the communicative wireless smart key in response to the alert.

18. The method as recited in claim 17, wherein the warning is at least one of for the user not to leave the vehicle while the vehicle is operating and while still in possession of the communicative wireless smart key and for the user not to leave another user without a key to the vehicle while the vehicle is operating.

19. The method as recited in claim 15, with a vehicle-installed sensor system in communication with the control system:

determine whether the communicative wireless smart key is within a predetermined range of the vehicle, and communicate corresponding signals to the control system from which the control system is operable to identify whether the communicative wireless smart key is within the predefined distance from the vehicle.

20. The method as recited in claim 15, further comprising: with the control system, send the alert to a vehicle-installed head unit in communication with the control system; and with the head unit, issue a warning to a user in the vehicle cabin in response to the alert that the user is being left without a key to the vehicle while the vehicle is operating.

* * * * *

UNITED STATES PATENT AND TRADEMARK OFFICE

CERTIFICATE OF CORRECTION

PATENT NO. : 9,495,858 B2
APPLICATION NO. : 14/604724
DATED : November 15, 2016
INVENTOR(S) : Kenan Kurtovic It is certified that error appears in the above-identified patent and that said Letters Patent is hereby corrected as shown below:

In the Specification

Column 7, Line 3: Replace “triangulating” with --triangulate--
Column 8, Line 7: Replace “claim 15” with --claim 15, further comprising:--

Signed and Sealed this
Sixth Day of June, 2017

Michelle K. Lee

Michelle K. Lee
*Director of the United States Patent and Trademark Office*